United States Patent [19]

Bellinghieri

[11] 4,155,368

[45] May 22, 1979

[54] SMOKING PIPE SEASONER

[76] Inventor: Santo Bellinghieri, 75 N. Union St., Arlington, Mass. 02174

[21] Appl. No.: 800,922

[22] Filed: May 26, 1977

[51] Int. Cl.[2] ..... A24F 11/00

[52] U.S. Cl. ..... 131/172

[58] Field of Search ..... 131/198 A, 170 R, 171 R, 131/170 A, 171 A, 172, 260

[56] References Cited

U.S. PATENT DOCUMENTS 2,639,716 5/1953 Bellinghieri ..... 131/172

FOREIGN PATENT DOCUMENTS 939 of 1907 United Kingdom ..... 131/172

*Primary Examiner*—Robert W. Michell
*Assistant Examiner*—V. Millin
*Attorney, Agent, or Firm*—Clarence A. O'Brien; Harvey B. Jacobson

[57] ABSTRACT

A mount is provided including a support for supporting a pipe therefrom with the bowl portion of the pipe opening upwardly and vacuum generator structure is supported from the mount and includes an inlet and an outlet. Passage defining structure is provided and includes inlet and outlet end portions with the inlet end portion including structure for releasable sealed engagement with the smoke outlet in the free end portion of the stem of a pipe supported from the support structure. The outlet end portion is disposed in sealed communication with the inlet of the vacuum generating structure and the passage defining structure includes filter structure disposed therein and an ambient air inlet for admitting ambient air into the passage defining structure. The ambient air inlet includes adjustable valve structure operatively associated therewith for variably throttling the admission of ambient air into the passage defining structure through the ambient air inlet.

2 Claims, 4 Drawing Figures

SMOKING PIPE SEASONER

BACKGROUND OF THE INVENTION

It is well known that breaking in, or seasoning a new pipe is distasteful, to say the least, and very often discouraging to a pipe smoker. Moreover, the primary reason for pipe smokers reverting back to cigarettes is the foul taste and odor due to accumulated sludge in a pipe after 10 to 12 pipefuls of tobacco have been smoked therein. Also, the nearly impossible task of effectively removing the sludge from a pipe is also distasteful and discouraging. However, the smoking pipe seasoner has been designed to eliminate these distasteful and discouraging aspects associated with smoking a pipe.

Various forms of smoking pipe conditioners or seasoners have been heretofore designed. Many of these previous devices have been constructed in a manner whereby air is caused to pass through a pipe to be seasoned in a manner to slowly burn tobacco within the bowl of the pipe. However, some smokers prefer to break in their pipes with specific types of tobacco and various types of tobacco burn at different rates. Still further, many pipe smokers wish to break in a new pipe at different rates and most pipe seasoners of the type constructed to cause air to flow through the pipe include only minimal structure operative to control the flow of air through the pipe independent of the flow of air which may pass through the vacuum motor utilized to cause air to flow through the pipe.

Examples of previously known pipe seasoners including some of the general structural and operational features of this instant invention are disclosed in U.S. Pat. Nos. 1,740,334, 2,260,206, 2,639,716, 3,494,368, 3,587,594, and 3,786,576.

BRIEF DESCRIPTION OF THE INVENTION

The smoking pipe seasoner of the instant invention comprises the combination of over 40 years of research and development by a pipe smoker for the benefit and pleasure of the individual pipe smoker and those who prefer to smoke a pipe with its minimal adverse effects to health rather than to smoke cigarettes with their proven dangerous health hazards. The pipe seasoner of instant invention is constructed in a manner whereby it may be adjusted to the particular type of tobacco to be used during the breaking in of a pipe and the rate at which the owner of the pipe wishes his pipe to be broken in.

When tobacco is burned in a pipe, the ingredients in the tobacco used for curing and flavoring, such as honey and rum, etc., along with the carbon from burning, form a "cake" on the inside of the pipe bowl. This "cake" performs two functions. One function is to maintain the flavor of the particular tobacco being smoked and the second form is to act as insulation resulting in a cooler smoke.

One object of this invention is to provide a smoking pipe seasoner which may be adjusted to a particular tobacco to be used in breaking in a pipe and which may also be adjusted according to the desired time interval of the break in period.

More importantly, another object of this invention, in accordance with the immediately preceding object, is to provide a means whereby the smoke from tobacco being burned during the breaking in process may be filtered.

Yet another object of this invention is to provide an apparatus which may be utilized not only to break in a pipe but also to rejuvenate any pipe after smoking 10 to 12 pipefuls of tobacco by the removal of sludge therefrom.

A final object of this invention to be specifically enumerated herein is to provide a smoking pipe seasoner and cleaner which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
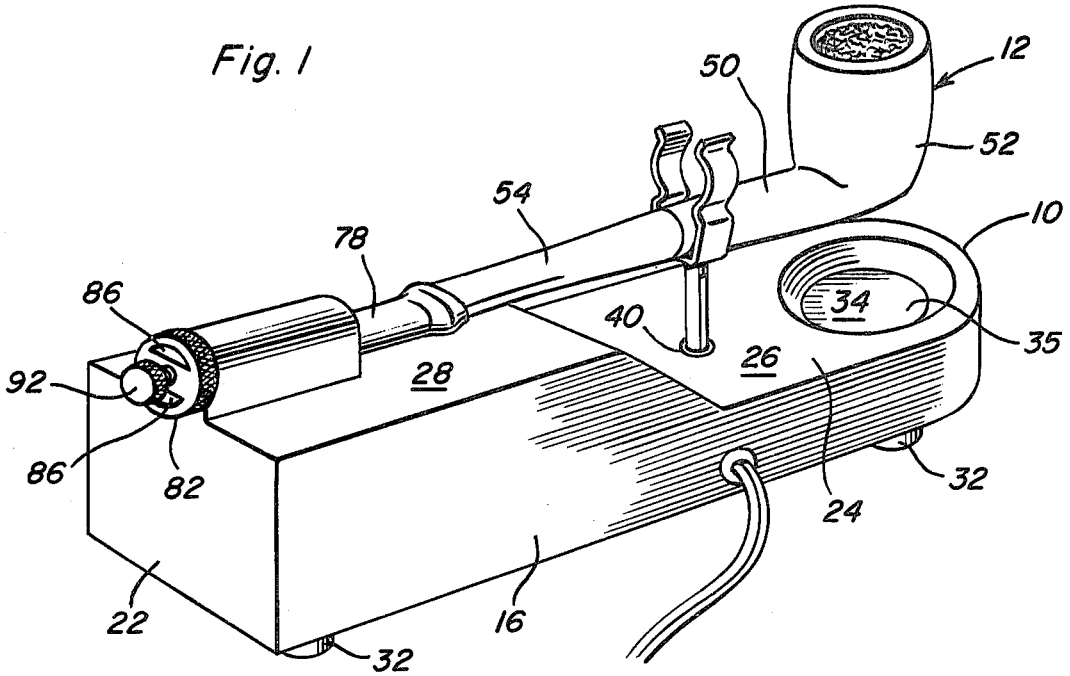
FIG. 1 is a perspective view of the smoking pipe seasoner of the instant invention with a conventional form of smoking pipe supported therefrom.

Referring now more specifically to the drawings, the numeral 10 generally designates the pipe seasoner of the instant invention and the reference numeral 12 generally designates a straight stem form of smoking pipe operatively supported from the seasoner 10 in FIG. 1.

The seasoner 10 includes a hollow housing referred to in general by the reference numeral 14 defined by interconnected opposite side walls 16 and 18, front and rear walls 20 and 22 and a top wall 24. The top wall 24 includes front and rear portions 26 and 28 interconnected at their rear and front marginal edges, respectively, by means of a rearwardly and upwardly inclined intermediate portion 30 of the top wall 24. The peripheral walls, including the walls 16, 18, 20 and 22, include lower inturned flanges and the housing 14 includes peripherally spaced depending feet 32 supported from these inturned flanges, whereby the housing 14 may be positioned upon a suitable horizontal support surface 34 without marring the surface, the feet 32 being constructed of resilient material.

The front portion 26 of the top wall 24 includes a depressed portion 35 defining an upwardly opening recess 36 and the front portion 26 has an opening 38 formed therein in which the upper end of a support sleeve 40 is secured. An upstanding support referred to in general by the reference numeral 42 is provided and includes an upstanding shank 44 whose lower end is longitudinally slotted as at 46 and snugly removably telescoped down into the sleeve 40 and frictionally maintained in position thereof. The upper end of the shank 44 has an upwardly opening U-shaped spring-type clamp 48 supported therefrom and the clamp 48 is utilized to clampingly support the neck 50 of the bowl portion 52 of the pipe 12 therefrom. The pipe 12 further includes a straight stem 54 which projects rearwardly from the neck 50 to a position spaced over the rear upper portion 28 of the top wall 24.

A vacuum motor assembly referred to in general by the reference numeral 56 is supported within the interior of the housing 14 beneath the rear portion 28 of the top wall 24 and the vacuum motor assembly 56 includes an air inlet 58 and air outlets 60 and a rotary impeller 62 driven by an electric motor 64 operative to draw air in through the inlet 58 and to pump air outwardly through the outlets 60. The side wall 18 of the housing 14 supports a control switch 66 serially interconnected in a power cord 68 for electrically connecting the motor 64 to suitable source of electrical potential, such as domestic house current. Accordingly, the motor 64 is under the control of the switch 66.

The housing 14 includes structure supported from the rear portion 28 of the top wall 24 defining an air passage 70 including an inlet end portion 72, an outlet end portion 74 and an intermediate portion 76 between the inlet and outlet end portions 72 and 74 and defined by an elongated chamber. The inlet end portion 72 includes a short section of flexible tubing 78 having one end thereof telescoped over the inlet end portion 72 and the other end of the tubing 78 may be sealingly telescoped over the free end of the stem 54 of the pipe 12 in order to communicate the outlet end of the smoke passage (not shown) extending through the stem 54 with the inlet end portion 72. The outlet end portion 74 opens laterally into the end of the chamber 76 remote from the inlet end portion 72 through a port 80 formed in the rear portion 28 of the top wall 24 and the end of the chamber 76 remote from the inlet end portion 72 is internally threaded and removably closed by means of a threaded closure 82. The closure 82 has a central threaded bore 84 formed therethrough and a plurality of ambient air inlet ports 86 formed therethrough spaced about the bore 84. A threaded shank 88 is threaded through the bore 84 and includes an enlarged head 90 on its inner end for movement into and out of registry with the ports 86. The outer end of the shank 88 includes an enlarged knob 92 by which the shank 88 may be turned from the exterior of the housing 14 in order to adjust the valve head 90 toward and away from the inner ends of the ports 86 in order to adjustably throttle the same.

The interior of the chamber 76 is filled with a fibrous filter material 94 and the filter material 94 may be renewed through the end of the chamber 76 closed by the closure 82.

Figure 2:
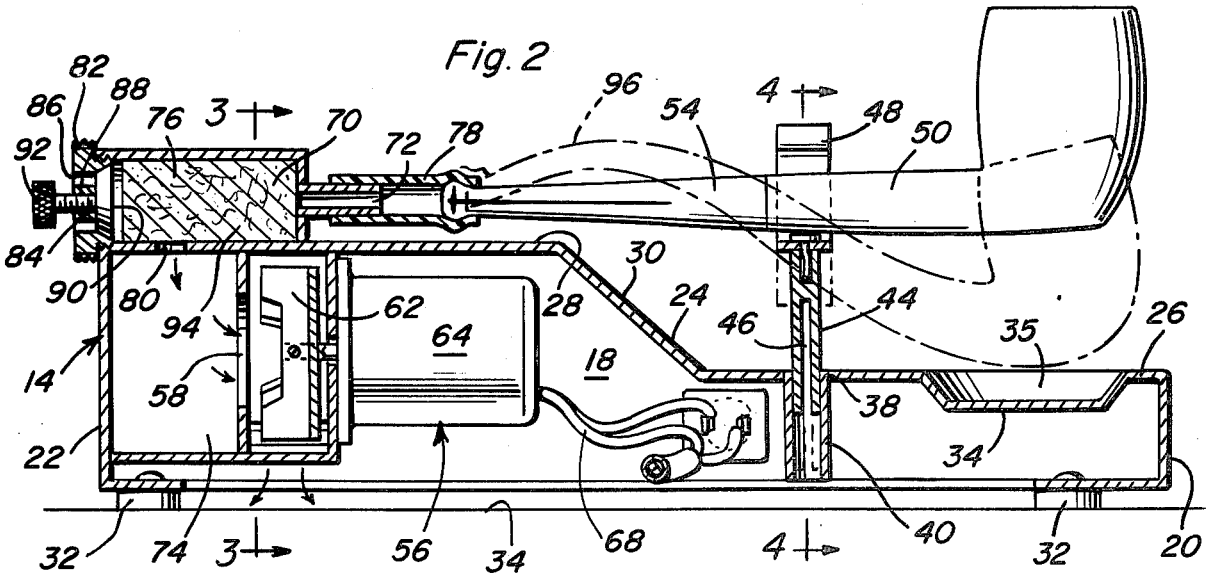
FIG. 2 is an enlarged, longitudinal, vertical sectional view of the assemblage illustrated in FIG. 1 and with an alternate form of smoking pipe illustrated in phantom lines.
Figure 3:
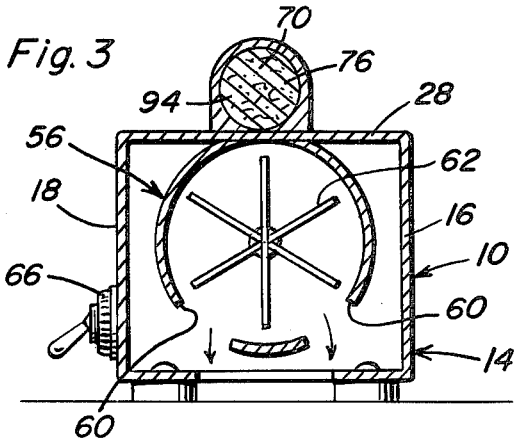
FIG. 3 is a transverse, vertical sectional view taken substantially upon the plane indicated by the section line 3—3 of FIG. 2.
Figure 4:
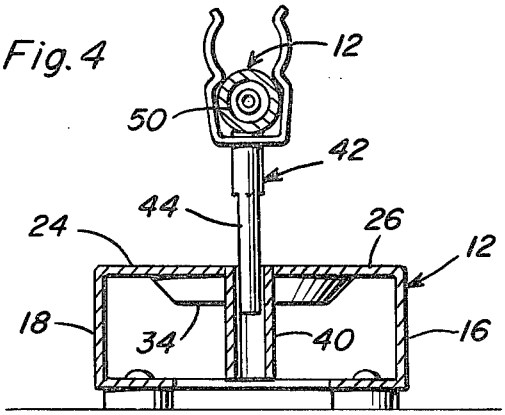
FIG. 4 is a transverse, vertical sectional view taken substantially upon the plane indicated by the section line 4—4 of FIG. 2.

As may be seen from FIG. 2 of the drawings, the clamp 48 supports the neck 50 of the straight stem pipe 12 therefrom. However, a curved stem pipe is generally designated by the reference numeral 96 and it may be seen that the shank 44 may be vertically adjusted in the sleeve 40 so as to appropriately position the clamp 48 for supporting the curved stem pipe 96 with the free end of the stem thereof in substantially the same location as the free end of the stem 54 of the pipe 12.

In operation, a quantity of tobacco may be placed within the bowl 52 of the pipe 12 and the switch 66 may be actuated in order to cause air to be drawn through the pipe 12. Then, the tobacco may be ignited within the bowl and the knob 92 may be turned so as to adjust the valve head 90 to the desired position whereby only a portion of the air through the vacuum motor assembly will be caused to flow through the pipe 12, the remainder of the air being drawn through the vacuum motor assembly 56 being from the exterior of the housing 14 and admitted into the chamber 76 through ports 86. In this manner, the heat of burning tobacco within the bowl 52 during the initial break in period may be adjusted as desired. Of course, the filter material 90 filters the smoke being drawn from the stem 54 of the pipe 12 and therefore does not allow the room in which the seasoner 10 is being used to be filled with smoke. Further, the motor 64 is not subject to operation with air to the impeller being excessively restricted as would be the case if the ports 86 were not provided and it was necessary to throttle air flow through the passage 70 in order to control the air flow through the pipe 12.

The breaking in of a pipe may be accelerated or decelerated by adjustment of the valve head 90 and the adjustment of the valve head 90 may also be utilized to compensate for different types of tobacco being used during the initial break period.

After 10 to 12 pipefuls of tobacco are smoke in a pipe, the accumulated sludge must be removed from the pipe to maintain its enjoyable qualities. A proper solvent is poured into the bowl 52 of the pipe 12 with the bowl 52 sufficiently lowered relative to the outlet end of the stem 54 to prevent the solvent from draining from the bowl 52 through the stem 54. The solvent is allowed to stand within the bowl of the pipe for approximately 30 minutes before the switch 66 is activated in order to cause the solvent to be drawn from the bowl 52 and through the passage 70 and the filter therein. Of course, the solvent will be absorbed by the filter and after the motor 64 has been allowed to operate for a few minutes, it will be found that the pipe is completely dry and aired out and can thus be smoked immediately. Of course, after the filter material 94 has been utilized to trap the solvent and the tar and sludge from the bowl, the filter material 94 may be replaced.

The foregoing is considered as illustrative only of the principles of the invention. Further, since numerous modifications and changes will readily occur those skilled in the art, it is not desired to limit the invention to the exact construction and operation shown and described, and accordingly all suitable modifications and equivalents may be resorted to, falling within the scope of the invention.

What is claimed as new is as follows:

1. A mount including support means for supporting a smoking pipe therefrom of the type including an upwardly opening bowl and a stem opening and projecting outwardly of the bowl defining a smoke outlet in the outer end of said stem, vacuum generating means supported from said mount and including an inlet and an outlet, passage means including inlet and outlet end portions, said inlet end portion including means for removable sealed communication with said smoke outlet, said outlet end portion being in sealed communication with said inlet, said passage means including filter means disposed therein and ambient air inlet means for admitting ambient air into said passage means, said ambient air inlet means including adjustable valve means operatively associated therewith for variably throttling the admission of ambient air into said passage means through said air inlet means, said passage means defining an enlarged diameter elongated chamber interposed intermediate said inlet and outlet end portions and establishing communication therebetween, said inlet end portion opening into one end portion of said chamber, said filter means including filter material disposed within said chamber intermediate the opposite end portions thereof, and said outlet end portion of said passage means opening laterally into the other end portion of said chamber, said other end portion of said chamber being open, a removable closure for said other end of said chamber, said filter material being replaceable through said open other end portion of said chamber upon removal of said closure, said outlet end portion of said passage means opening laterally into said other end portion of said chamber inwardly of said removable closure, said closure including a threaded bore formed therethrough opending inwardly into said chamber, an adjustable shank threaded through said bore and including an inner end within said chamber, said valve means including a diametrically enlarged head carried by the inner end of said shank, said ambient air inlet means comprising at least one air inlet port formed through said closure spaced from said threaded bore, said head being shiftable, upon outward and inward threaded movement of said shank through said bore, toward and away from a position in covering registry with the inner end of said port in order to variably close and open said port.

2. The combination of claim 1 wherein said mount includes an upstanding upwardly opening support sleeve, said support means comprising an upwardly opening spring type U-shaped clamp for clampingly engaging the stem of said pipe and including a depending support shank frictionally telescoped downwardly in the upper end portion of said support.

* * * * *